US006973969B2

(12) United States Patent
Roddy et al.

(10) Patent No.: US 6,973,969 B2
(45) Date of Patent: Dec. 13, 2005

(54) APPARATUS AND METHODS FOR PREVENTING OR LIMITING ROTATION OF CEMENTING PLUGS

(75) Inventors: Craig W. Roddy, Duncan, OK (US); Anthony M. Badalamenti, Katy, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 46 days.

(21) Appl. No.: 10/638,042

(22) Filed: Aug. 8, 2003

(65) Prior Publication Data

US 2005/0028985 A1 Feb. 10, 2005

(51) Int. Cl.[7] ..... E21B 33/16

(52) U.S. Cl. ..... 166/291; 166/156; 166/177.4; 166/242.1

(58) Field of Search ..... 166/153, 155, 166/156, 291, 177.4, 241.1, 242.1

(56) References Cited

U.S. PATENT DOCUMENTS

| | | | | |
|---|---|---|---|---|
| 1,896,104 | A | 2/1933 | Simmons | |
| 2,165,433 | A | 7/1939 | Wickersham | |
| 2,178,847 | A | 11/1939 | Baker et al. | |
| 2,560,692 | A | 7/1951 | Hall | |
| 2,662,600 | A | 12/1953 | Baker et al. | 166/1 |
| 3,385,679 | A | 5/1968 | Current | 29/190 |
| 3,448,802 | A | 6/1969 | Page | |
| 3,550,683 | A | 12/1970 | Comeaux | |
| 3,818,999 | A | 6/1974 | Garrett | |
| 3,913,686 | A | 10/1975 | Manson, Jr. | |
| 4,060,131 | A | 11/1977 | Kenneday et al. | 166/315 |
| 4,175,619 | A | 11/1979 | Davis | |
| 4,190,111 | A | 2/1980 | Davis | |
| 4,190,112 | A | 2/1980 | Davis | |
| 4,574,883 | A | 3/1986 | Carroll et al. | |
| 4,711,300 | A | 12/1987 | Wardlan, III et al. | |
| 4,836,279 | A | 6/1989 | Freeman | |
| 4,858,687 | A | 8/1989 | Watson et al. | |
| 4,979,562 | A | 12/1990 | Langer | |
| 5,025,858 | A | 6/1991 | Glaser | |
| 5,095,980 | A | 3/1992 | Watson | |
| 5,113,940 | A | 5/1992 | Glaser | |
| 5,165,474 | A | 11/1992 | Buisine et al. | |
| 5,234,052 | A | 8/1993 | Coone et al. | |
| 5,246,069 | A | 9/1993 | Glaser et al. | |

(Continued)

FOREIGN PATENT DOCUMENTS

| | | |
|---|---|---|
| WO | WO 01/09480 A1 | 2/2001 |

(Continued)

OTHER PUBLICATIONS

U.S. Appl. No. 10/201,505, filed Jul. 23, 2002, Butterfield et al.

(Continued)

*Primary Examiner*—William Neuder
(74) *Attorney, Agent, or Firm*—Craig W. Roddy; Robert A. Kent; McAfee & Taft P.C.

(57) ABSTRACT

Methods and apparatus for preventing or limiting the rotation of downhole tools, such as cementing plugs, in a casing string during drillout. The apparatus includes an outer case and a radially expandable sleeve disposed therein. The sleeves will engage cementing plugs received therein. The sleeves radially expand when cementing plugs are received therein to grippingly engage the outer case and prevent or limit rotation thereof during drillout.

72 Claims, 5 Drawing Sheets

U.S. PATENT DOCUMENTS 5,351,720 A * 10/1994 Maimets ..... 138/98
5,390,736 A 2/1995 Budde
5,566,757 A 10/1996 Carpenter et al. ..... 166/285
5,641,021 A 6/1997 Murray et al.
5,669,457 A 9/1997 Sebastian et al.
5,722,491 A 3/1998 Sullaway et al.
5,842,517 A 12/1998 Coone
6,056,053 A 5/2000 Giroux et al.
6,138,718 A * 10/2000 Maimets ..... 138/98
6,196,311 B1 3/2001 Treece
6,315,040 B1 11/2001 Donnelly
6,425,442 B1 * 7/2002 Latiolais et al. ..... 166/242.1
6,796,377 B2 * 9/2004 Butterfield et al. ..... 166/156

FOREIGN PATENT DOCUMENTS

WO WO 01/09481 A1 2/2001
WO WO 03-046334 A1 6/2003

OTHER PUBLICATIONS

Foreign communication from a related counterpart application dated Sep. 15, 2004.

* cited by examiner

APPARATUS AND METHODS FOR PREVENTING OR LIMITING ROTATION OF CEMENTING PLUGS

The present invention relates generally to drilling and completion techniques for downhole wells and, more particularly, to apparatus and methods for preventing or limiting rotation of downhole tools, such as cementing plugs, while being drilled out.

In the construction of oil and gas wells, a wellbore is drilled into one or more subterranean formations or zones containing oil and/or gas to be produced. During a wellbore drilling operation, drilling fluid (also called drilling mud) is circulated through the wellbore by pumping it down the drill string, through a drill bit connected thereto and upwardly back to the surface to the annulus between the walls of the wellbore and the drill string. The circulation of the drilling fluid functions to lubricate the drill bit, remove cuttings from the wellbore as they are produced and to exert hydrostatic pressure on pressurized fluid contained formations penetrated by the wellbore whereby blowouts are prevented.

In most instances, after the wellbore is drilled, the drill string is removed and a casing string is run into the wellbore while maintaining sufficient drilling fluid in the wellbore to prevent blowouts. The term "casing string" is used herein to mean any string of pipe which is lowered into and cemented in a wellbore including but not limited to surface casing, liners and the like.

Typically, at the beginning of a cementing job, the casing and hole are filled with drilling mud. Very often, a bottom cementing plug is pumped ahead of the cement slurry to reduce contamination at the interface between the mud and cement. The bottom plug is typically constructed to have elastomeric wipers to wipe the casing of drilling mud and thereby separate the drilling mud ahead of the bottom plug from the cement slurry behind the bottom plug. Examples of cementing plugs are taught in U.S. Pat. Nos. 5,722,491 and 6,196,311. The casing string will have a landing platform for the bottom plug. The landing platform may be a float collar, a float shoe or a shoulder in the casing string or other tool for stopping the bottom plug. When the bottom plug seats upon the landing platform, the fluid pressure differential created across the bottom plug ruptures a diaphragm at the top of the bottom plug and allows the cement slurry to proceed down the casing through the plug, through the float equipment at the lower end of the casing and up the annular space between the casing and the wellbore.

Once the required amount of cement has been displaced into the well, a top cementing plug, which will likewise have wipers thereon, may be displaced into the casing. The top cementing plug will follow the cement slurry into the casing, and is designed to reduce the possibility of any contamination or channeling of the cement slurry with drilling fluid or other fluid that is used to displace the cement column down into the casing and into the annular space between the casing and the wellbore. The top cementing plug does not have a fluid passage therethrough such that when it reaches the bottom cementing plug, the top cementing plug will cause a shutoff of fluids being pumped through the casing.

Once the cement has set up and any other desired operations have been performed, the cementing plugs, along with float equipment therebelow, may be drilled out. In order to do so, the drill string with the drill bit thereon is lowered into the hole until the drill bit engages the top plug and is rotated. In many instances, however, when the drill bit is rotated, the top plug also begins to rotate on top of the bottom plug, or the bottom plug may rotate on the landing platform, whether the platform is float equipment or a shoulder or other restriction in the casing. Plug rotation can cost valuable time and therefore can have an economic impact on the cost of the well. Thus, there is a need to eliminate or at least limit the rotation of the cementing plugs while they are being drilled out after the cementing job. Several attempts have been made at preventing the rotation of cementing plugs. One such attempt is described in U.S. Pat. No. 6,425,442 B1, entitled Anti-Rotation Device for Use with Well Tools. A drillable, non-metallic, non-rotating plug set for use in well cementing operations is described in U.S. Pat. No. 5,095,980. Other devices and/or methods are shown in U.S. Pat. Nos. 5,390,736; 5,165,474; and 4,190,111. U.S. patent application Ser. No. 10/201,505 filed Jul. 23, 2002, assigned to the assignee of the present application, also addresses such concerns. Although the apparatus and methods described therein may in some cases work well to prevent or limit rotation of cementing plugs while being drilled out, there is a continuing need for improved anti-rotation apparatus and methods which will prevent or limit the rotation of the cementing plugs while being drilled out and which are easy to use, efficient and inexpensive.

SUMMARY OF THE INVENTION

The present invention provides apparatus and methods for preventing, or at least limiting, the rotation of a cementing plug or plugs while being drilled out. The apparatus includes an outer case, such as a joint of casing string, having an expandable inner sleeve disposed therein. The inner sleeve has an open upper end and an open lower end and is adapted to receive cementing plugs displaced through a casing string during a cementing job. The inner sleeve is constructed to radially expand and engage the outer case when the cementing plug(s) is received therein. Preferably, the inner sleeve has overlapping longitudinal edges that will slide relative to one another when the inner sleeve receives a plug and expands radially to engage the outer case. Thus, the apparatus restricts rotation of cementing plug(s) by engaging the plug(s) that are received therein so that when rotational drilling forces are applied, rotation of the plug is prevented or limited.

In a preferred embodiment, the inner surface of the inner sleeve is configured and dimensioned so as to cause an interference fit, and thus, frictionally engage one or more cementing plugs that are received therein. Means for limiting rotation of the plug(s) relative to the inner surface of the inner sleeve are taught in U.S. Pat. No. 6,425,442 B1 and U.S. patent application Ser. No. 10/201,505 filed Jul. 23, 2002, each of which is incorporated by reference herein in its entirety. Engagement between the cementing plugs and the inner sleeve, and between the inner sleeve and the outer case will prevent or limit rotation of the cementing plugs while being drilled out after a cementing job. The inner sleeve is preferably comprised of a durable, drillable material selected from the group of rubbers, elastomers, plastics, wood, drillable metals or any other drillable material that is suitable for downhole use. The inner sleeve can be made to accommodate various desired lengths such as for one plug, two plugs, or multiple plug operations.

Other and further objects, features and advantages of the present invention will be readily apparent to those skilled in the art upon reading of the description of preferred embodiments which follows.

DESCRIPTION OF PREFERRED EMBODIMENTS

Figure 1:
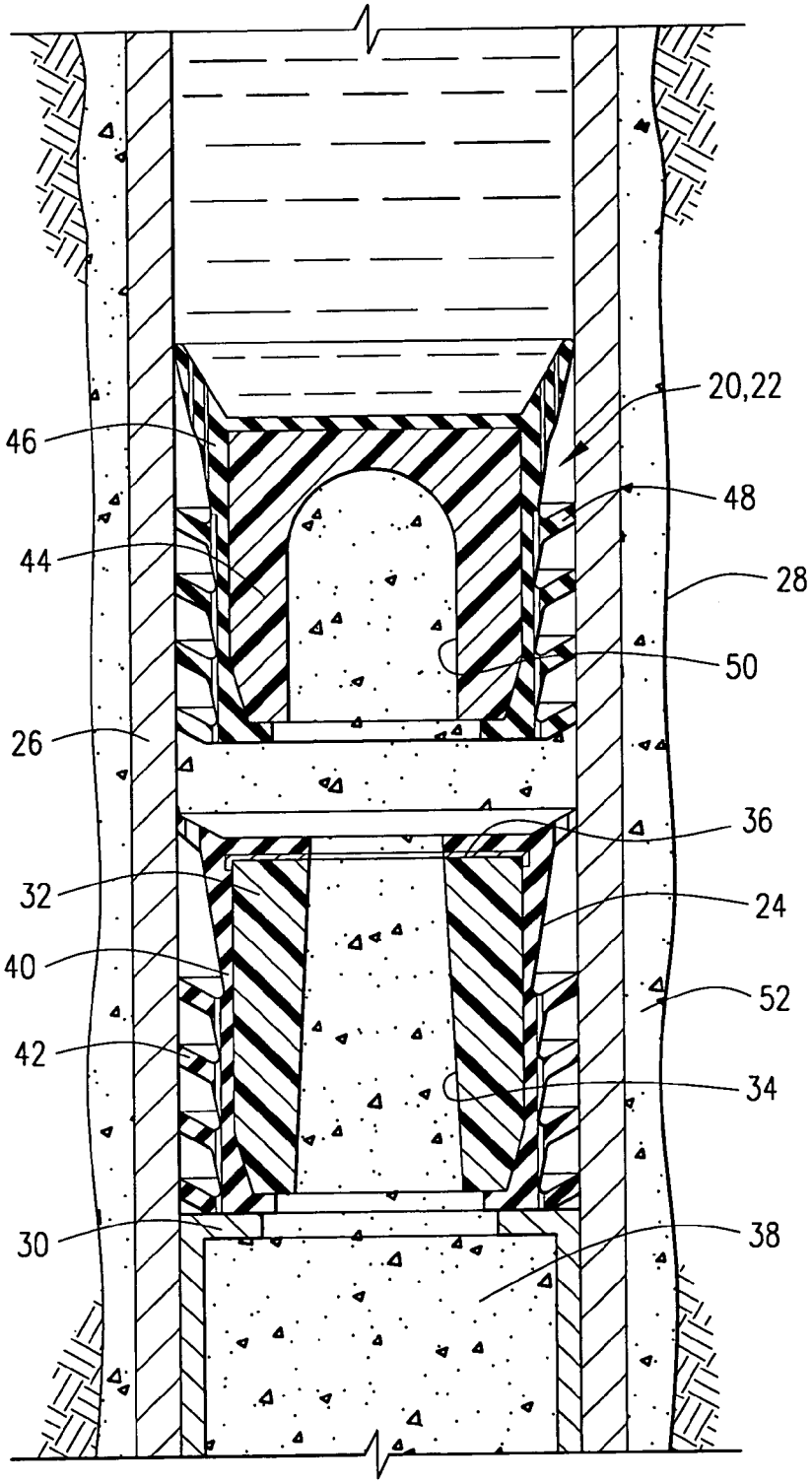
FIG. 1 PRIOR ART
FIG. 1 shows a side cross-sectional view of a prior art plug set displaced into a casing.

The present invention provides improved anti-rotation apparatus and methods for preventing or limiting plug rotation in wellbore operations, e.g., oil and gas well cementing operations. Referring now to the drawings and more particularly to FIG. 1, a prior art cementing plug set 20 is shown. Plug set 20 includes a top cementing plug 22 and a bottom cementing plug 24. The plug set 20 is shown in an outer case or casing 26 such as a joint of casing string or pipe string, in a preferred embodiment, a steel, non-drillable string of cylindrical oilfield casing being cemented into a wellbore 28. Plug set 20 is shown after bottom cementing plug 24 has landed on a landing platform 30 which may comprise a float collar, float shoe or other float equipment, or any other restriction which will allow bottom cementing plug 24 to land, but which will also allow fluid flow therethrough. Bottom cementing plug 24 comprises a body 32 defining a flow passage 34 therethrough. Typically, a rupturable member 36 will be disposed across the top of flow passage 34 such that when bottom cementing plug 24 lands, increasing fluid pressure will cause the rupturable member 36 to burst so that fluid, such as a cement slurry 38, can flow through flow passage 34. In FIG. 1, the rupturable member has already been ruptured to allow flow through flow passage 34. Bottom cementing plug 24 also includes an elastomeric cover 40 disposed about body 32. Elastomeric cover 40 includes a plurality of wipers 42. As explained above, bottom cementing plug 24 will normally be placed in the casing 26 ahead of the cement slurry 38 to wipe off the inner surface of the casing 26 and separate the drilling fluid from the cement slurry 38. Top cementing plug 22 has a body 44 with an elastomeric cover 46 disposed thereabout. Elastomeric cover 46 includes elastomeric wipers 48. Body 44 defines a central cavity 50.

Top cementing plug 22 is displaced into the casing 26 above the cement slurry 38 to separate the cement slurry 38 from the drilling or other fluids thereabove utilized to urge the cement slurry 38 downwardly through the casing 26 and into the annulus 52 between casing 26 and the wellbore 28. FIG. 1 shows top cementing plug 22 prior to the time it engages and seats upon bottom cementing plug 24.

Figure 2:
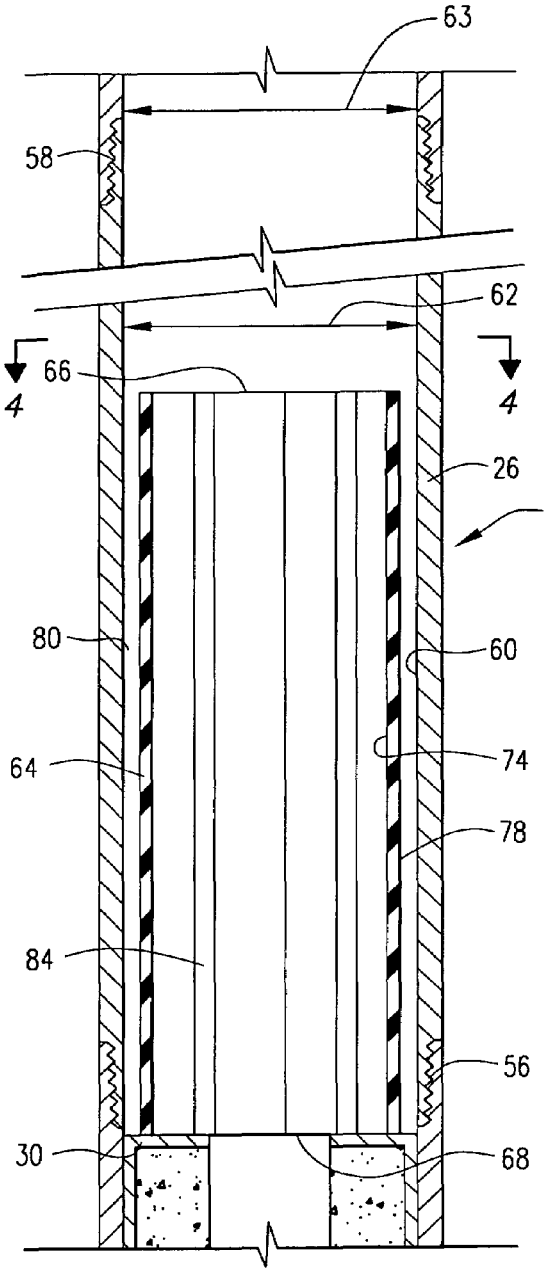
FIG. 2 shows a side cross-sectional view of an anti-rotation apparatus of the present invention.
Figure 3:
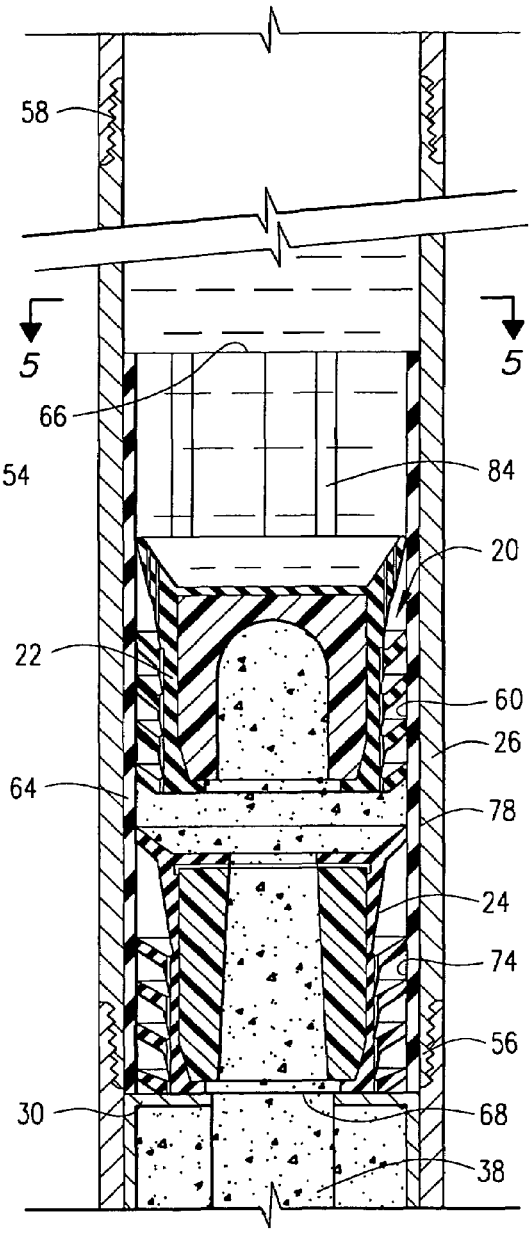
FIG. 3 shows a side cross-sectional view of the anti-rotation apparatus of FIG. 2 with cementing plugs received therein.

Referring now to FIGS. 2 and 3, a preferred apparatus 54 of the present invention for limiting rotation of a cementing plug or plug set 20 when rotational forces, such as forces applied by a drill bit during drillout, are applied is shown. Apparatus 54 includes outer case 26 which is preferably a casing joint that can be threadedly connected in and will make up a part of a casing string lowered into a wellbore 28. Outer case 26 has a lower end 56, an upper end 58 and an inner surface 60. Outer case 26 defines an inner diameter 62 that is preferably substantially identical to the inner diameter 63 of the casing string in which apparatus 54 is connected. Apparatus 54 has an inner sleeve 64 disposed in outer case 26. Inner sleeve 64 is preferably comprised of a drillable material and is radially expandable. Preferred materials for use in constructing the inner sleeve 64 include, but are not necessarily limited to, durable, drillable materials such as rubbers, elastomers, plastics, wood, drillable metals or any other drillable material that is suitable for downhole use. Furthermore, FIG. 3 shows a plug set 20 in combination with the apparatus 54.

Figure 4:
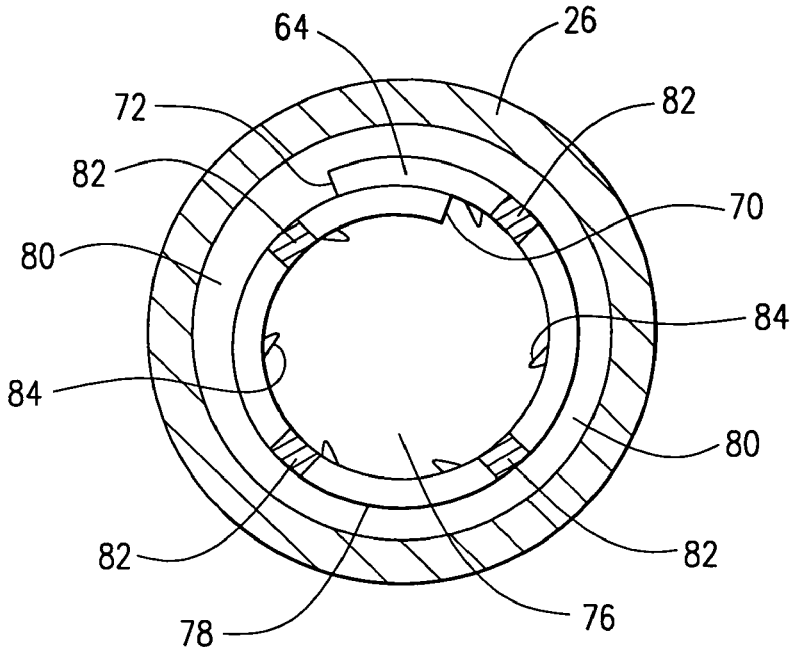
FIG. 4 shows a view from line 4—4 of FIG. 2.
Figure 5:
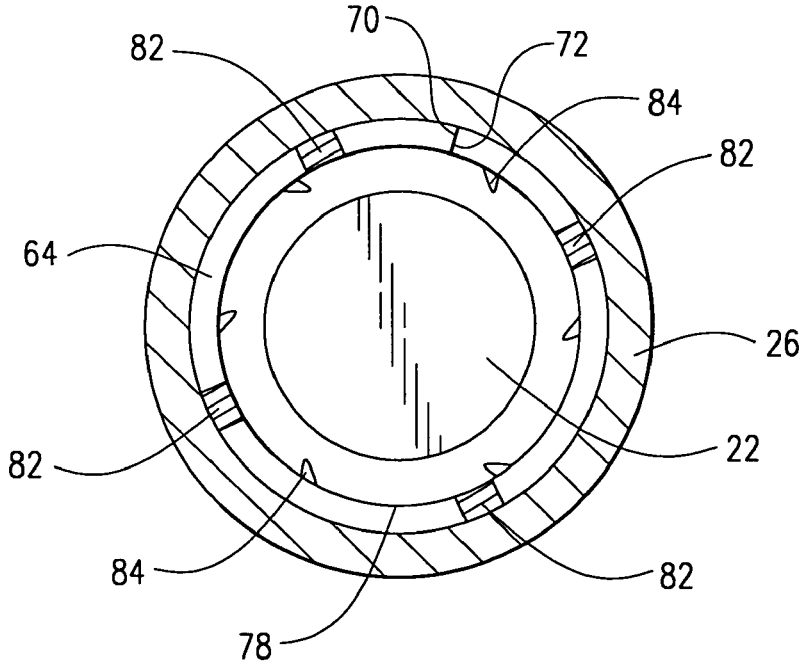
FIG. 5 shows a view from line 5—5 of FIG. 3.

Inner sleeve 64 has an upper end 66 and a lower end 68. Upper and lower ends 66 and 68 are open and upper end 66 is adapted to receive one or more cementing plugs, such as top and bottom cementing plugs 22 and 24. Inner sleeve 64 preferably has first and second longitudinal edges 70 and 72, respectively. Prior to cementing plugs 22 and 24 being received into inner sleeve 64, longitudinal edges 70 and 72 preferably overlap, as shown in FIG. 4. Overlapping longitudinal edges 70 and 72 will move relative to each other as inner sleeve 64 expands to engage outer case 26. Inner sleeve 64 has an inner surface 74 that defines passageway 76. Once the plugs 22 and 24 are received in the passageway 76 of inner sleeve 64, longitudinal edges 70 and 72 may continue to overlap, spread apart or abut one another as shown in FIG. 5.

Inner sleeve 64 has an outer surface 78. Inner sleeve 64 and outer case 26 define a space or annulus 80 therebetween. Thus, inner sleeve 64 has a smaller outer diameter than the inner diameter 62 of outer case 26 when it is in its relaxed condition, as shown in FIG. 2, prior to the time cementing plugs 22 and 24 are received therein.

As shown in FIG. 3, bottom cementing plug 24 has been displaced into the casing string 26 and has engaged landing platform 30 which as set forth above may comprise a float collar, a float shoe or other float equipment, or may comprise a shoulder or other restriction in the casing which provides a barrier to stop bottom cementing plug 24. Top cementing plug 22 is shown just prior to the time that it engages bottom cementing plug 24. Top and bottom cementing plugs 22 and 24 are received in the open upper end 66 of inner sleeve 64. Top and bottom cementing plugs 22 and 24 have an unrestrained outer diameter defined by the wipers 42 and 48 thereon that is greater than inner diameter 63 of the casing string so that the plugs 22 and 24 will effectively wipe the inner surface thereof as it passes therethrough. Top and bottom cementing plugs 22 and 24 will be engaged by the inner surface 74 of the expandable inner sleeve 64 upon entering through the open upper end 66 thereof. When bottom cementing plug 24 is received in the expandable inner sleeve 64, it will engage expandable sleeve 64 and urge it radially outwardly so that it engages outer case 26.

Plugs 22 and 24 will engage the radially expandable inner sleeve 64, and expandable inner sleeve 64 will engage outer case 26 such that once the cementing job is complete, the engagement will prevent, or at least limit, the rotation of the cementing plugs 22 and 24 while being drilled out. In other words, when rotational forces, such as drilling forces, are applied to top and bottom cementing plugs 22 and 24, the expandable inner sleeve 64 will engage and hold top and bottom cementing plugs 22 and 24 in place and inner sleeve 64 will be held in place by the engagement of inner sleeve 64 with outer case 26. It is understood that any design and/or material, which prevents or limits movement between the inner sleeve 64 and outer case 26 when the sleeve 64 is radially expanded, may be used. This is preferably accomplished by utilizing elastomeric or rubber materials that can be expanded wherein the outer surface 78 will grab, or grip the inner surface 60 of outer case 26 when forced into engagement therewith by cementing plugs 22 and 24. If desired, the outer surface 78 of the expandable inner sleeve 64 may have protrusions, grooves and/or an abrasive surface to grip inner surface 60 of outer case 26 and limit or prevent rotation of expanded inner sleeve 64 and thus the plugs 22 and 24 received therein. As shown in FIG. 5, inner sleeve 64 may also have stiffening ribs 82 made from a drillable material to prevent inner sleeve 64 from collapsing when top and bottom cementing plugs 22 and 24 are received therein. Ribs 82 may extend from the upper end 66 to the lower end 68 of inner sleeve 64.

The inner surface 74 of the expandable inner sleeve 64 preferably has protrusions 84 thereon as shown in FIG. 5.

Figure 6:
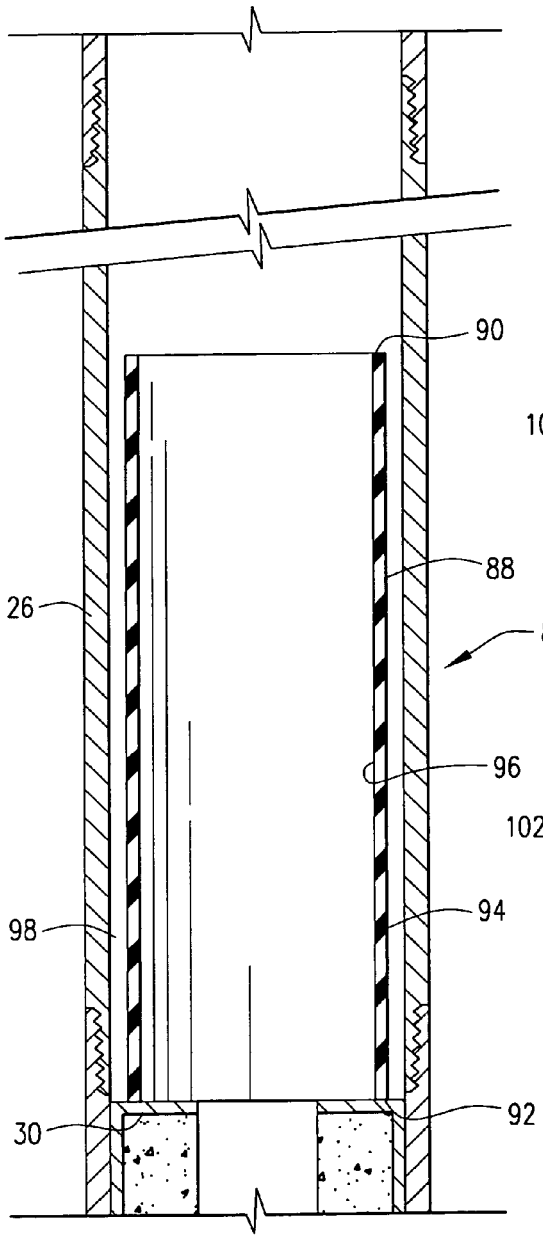
FIG. 6 shows a side cross-sectional view of an additional embodiment of an anti-rotation apparatus of the present invention wherein the inner sleeve has a continuous outer diameter.

Additional embodiments of the current invention are shown in FIGS. 6–9. FIG. 6 shows an apparatus 86 for limiting, or preventing rotation during drillout of cementing plugs. Apparatus 86 includes outer housing or outer case 26 and radially expandable inner sleeve 88. Radially expandable inner sleeve 88 is similar to inner sleeve 64 except that inner sleeve 88 is constructed without overlapping longitudinal edges. Thus, radially expandable inner sleeve 88 has upper end 90, lower end 92, outer surface 94 and inner surface 96. An annulus 98 is defined between outer surface 94 and outer case 26. Radially expandable sleeve 88 is preferably constructed with a drillable material that will radially expand outwardly to engage and grip outer case 26 when a radially outwardly directed force is applied to the inner surface 96 thereof such as, for example, by the receipt of top and bottom cementing plugs 22 and 24 therein.

Figure 7:
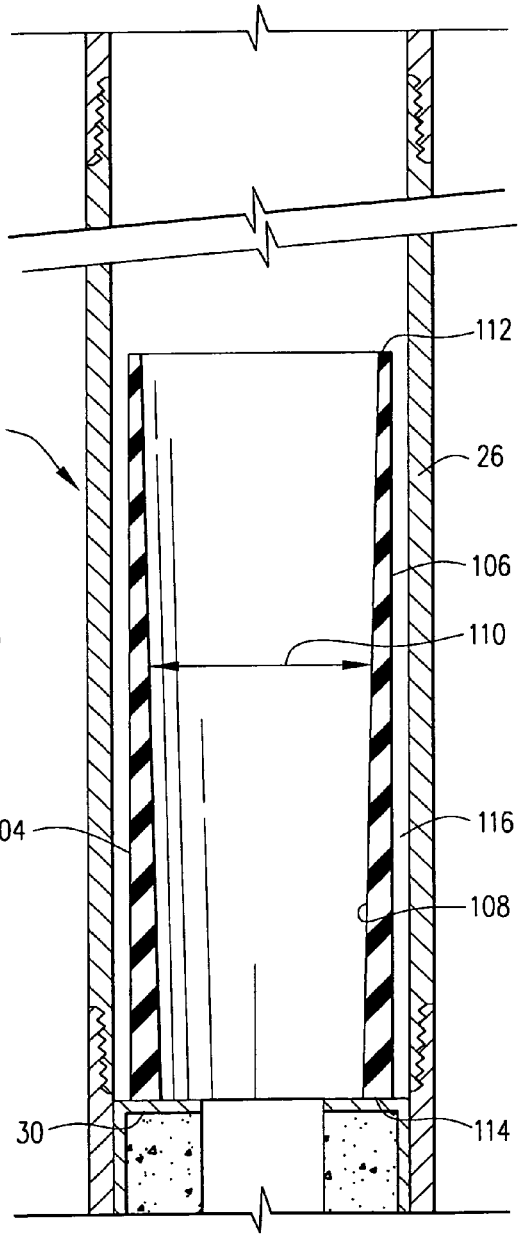
FIG. 7 shows a side cross-sectional view of an additional embodiment of an anti-rotation apparatus of the present invention wherein the diameter of the inner surface of the inner sleeve tapers radially inwardly from the upper end to the lower end thereof.

FIG. 7 shows an apparatus 100 for limiting or preventing rotation during drillout of cementing plugs. Apparatus 100 includes outer case 26 and inner sleeve 102. Inner sleeve 102, like inner sleeve 88 has a continuous outer diameter and thus does not have overlapping longitudinal edges. Radially expandable sleeve 102 has an outer surface 104 that defines a continuous outer diameter 106 and has an inner surface 108. Inner surface 108 defines an inner diameter 110 that tapers radially inwardly from an upper end 112 of inner sleeve 102 to a lower end 114 thereof. An annulus 116 is defined between inner sleeve 102 and outer case 26. Tapered inner diameter 110 will increase the interference between cementing plugs 22 and 24 when the plugs are received therein. Inner sleeve 102 is comprised of a drillable material that will expand radially outwardly to grippingly engage outer case 26 when a radially outwardly directed force is applied to the inner surface thereof when the top and bottom cementing plugs 22 and 24 are received therein.

Figure 8:
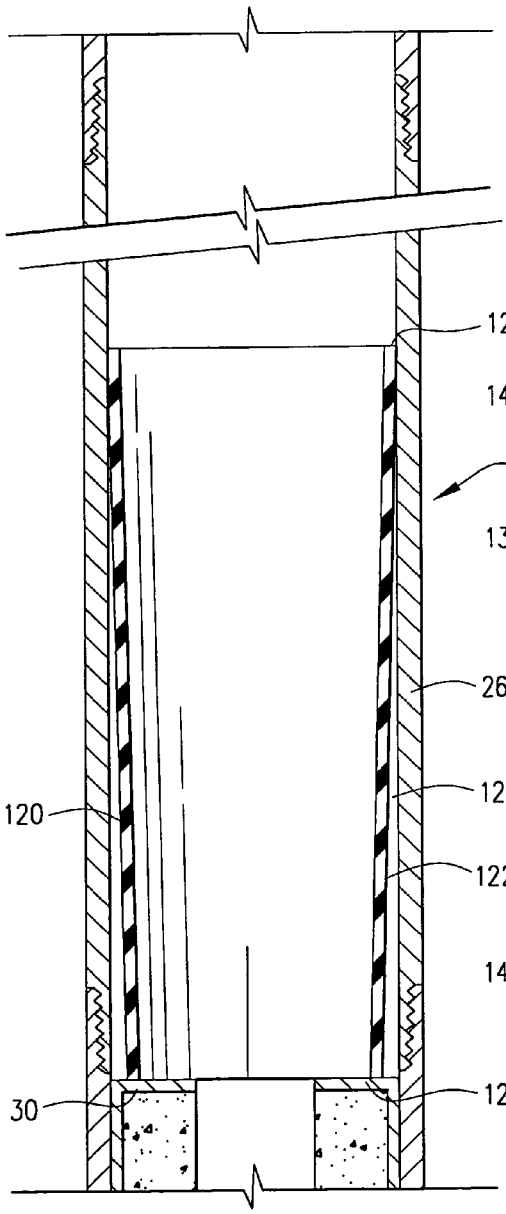
FIG. 8 shows a side cross-sectional view of an additional embodiment of an anti-rotation apparatus of the present invention wherein the inner sleeve has an outer diameter that tapers inwardly from the upper end to the lower end thereof.

An additional embodiment of an apparatus 118 of the present invention to limit, or prevent rotation during drillout is shown in FIG. 8. Apparatus 118 includes outer housing 26 and radially expandable inner sleeve 120. Inner sleeve 120 has an outer diameter 122 that tapers inwardly from an upper end 124 to a lower end 126 thereof. When cementing plugs 22 and 24 are received in the open upper end 124 of the expandable inner sleeve 120, plugs 22 and 24 will cause inner sleeve 120 to expand radially outwardly as the plugs move from the upper end 124 to the lower end 126 thereof to close tapered gap 128 and cause inner sleeve 120 to grippingly engage outer case 26. The engagement between plugs 22 and 24 and radially expandable inner sleeve 120 and the engagement between radially expandable inner sleeve 120 and outer case 26 will prevent or at least limit rotation of cementing plugs 22 and 24 during drillout of the plugs 22 and 24.

Figure 9:
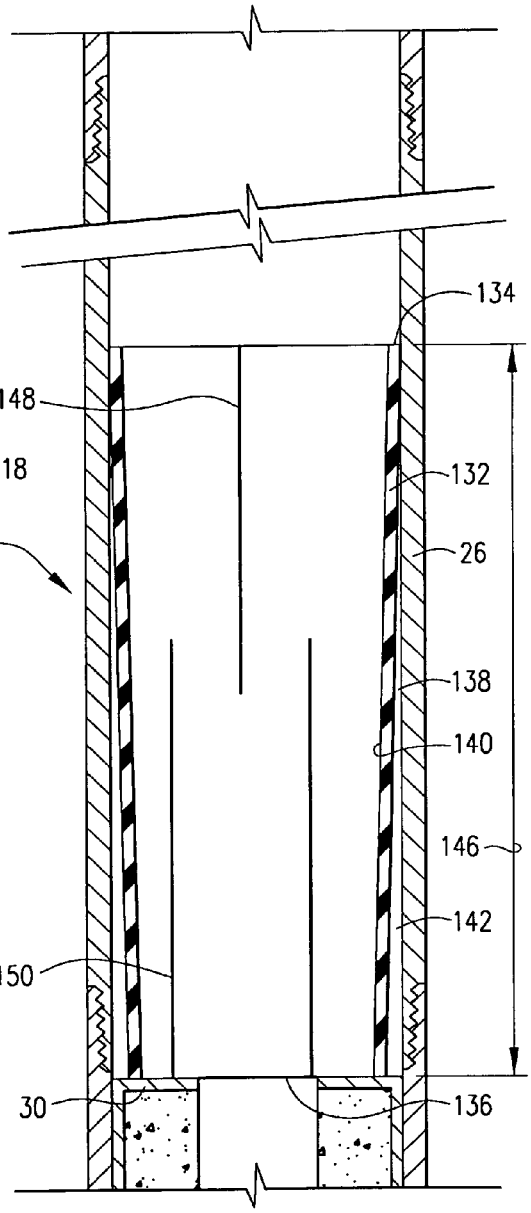
FIG. 9 shows a side cross-sectional view of an additional embodiment of an anti-rotation apparatus of the present invention wherein the inner sleeve has a plurality of slits.

An additional embodiment of the current invention is shown in FIG. 9. An apparatus 130 for limiting rotation of cementing plugs 22 and 24 includes outer case 26 and a radially expandable inner sleeve 132. Radially expandable inner sleeve 132 has upper end 134 and lower end 136. Inner sleeve 132 tapers radially inwardly from upper end 134 to lower end 136, and has outer surface 138 and inner surface 140. A tapered gap 142 is defined by and between radially expandable inner sleeve 132 and outer case 26. Inner sleeve 132 may have a plurality of slits 144 cut therethrough extending for at least a portion of a length 146 thereof. Slits 144 preferably include a plurality of circumferentially spaced slits that extend for over at least half of the length 146. In addition, slits 144 may have a width to form slots that allow expansion. Slits 144 may include upper slits 148 that extend downwardly from upper end 134 for at least a portion of length 146 from upper end 134 and a plurality of lower slits 150 that extend upwardly from the lower end 136 of radially expandable sleeve 132 for a portion of length 146. Slits 144 will aid in the radial expansion of inner sleeve 132. It is understood that this embodiment may taper radially inwardly as shown or may be non-tapered as in the embodiments shown in FIGS. 2 and 6.

If desired, all of the embodiments described herein may have stiffening ribs 82 embedded therein or attached thereto that will prevent the inner sleeves 64, 88, 102, 120 and 132 of the various embodiments from collapsing upon being engaged by cementing plugs 22 and 24. The inner sleeves 64, 88, 102, 120 and 132 may likewise have either or both the inner surfaces and outer surfaces thereof tapered. The inner sleeves 64, 88, 102, 120 and 132 can also be made to accommodate various desired lengths such as for one plug, two plugs, or multiple plug operations and can have grooves or protrusions, such as protrusions 84 on inner sleeve 64, on the inner surface thereof. Other suitable means including, inter alia, grooves and abrasive surfaces for limiting rotation of the plugs 22 and 24 received in the inner sleeves 64, 88, 102, 120 and 132 are taught in U.S. Pat. No. 6,425,442 B1 and U.S. patent application Ser. No. 10/201,505 filed Jul. 23, 2002, each of which is incorporated by reference herein in its entirety. The engagement of plugs 22 and 24 with the inner sleeves 64, 88, 102, 120 and 132 and the engagement between the inner sleeves 64, 88, 102, 120 and 132 and outer case 26 is such that during drillout of the cementing plugs 22 and 24 rotation is prevented, or at least limited, to provide for easier drilling of the plugs 22 and 24.

The inner sleeves 64, 88, 102, 120 and 132 may be constructed of any suitable design and/or material sufficient to provide the desired expansion and prevent or limit the plugs 22 and 24 from rotating. Additionally, all of the inner sleeves 64, 88, 102, 120 and 132 may have protrusions, grooves, abrasives or other suitable limiting means on the inner surface thereof to aid in preventing or limiting rotation of the cementing plugs 22 and 24 inside the inner sleeves 64, 88, 102, 120 and 132. The outer surfaces of the inner sleeves

64, 88, 102, 120 and 132 may use various designs and/or materials to aid in the gripping between the inner sleeves 64, 88, 102, 120 and 132 and the outer case 26. Therefore, the surface of the inner sleeves 64, 88, 102, 120 and 132 will grip or frictionally engage the inner surfaces of outer case 26 and the material and/or internal design of the inner sleeves 64, 88, 102, 120 and 132 will engage the plugs 22 and 24 such that the inner sleeves 64, 88, 102, 120 and 132 and plugs 22 and 24 are prevented or limited from rotating during drillout.

A preferred method of completing a well utilizing the present invention comprises the steps of drilling a wellbore in a subterranean formation, placing a casing string containing the apparatus of the present invention in the wellbore, displacing a fluid or cement slurry through the casing string using one or more plugs, lodging the plugs within the inner sleeve of the apparatus thereby radially expanding the inner sleeve to grip the outer case and prevent or limit rotation of the apparatus and plugs, drilling out the apparatus and plugs, creating openings in the casing string adjacent to the formation, optionally stimulating the formation to produce hydrocarbons, and producing hydrocarbons or other desired fluid(s) from the formation.

Thus, the present invention is well adapted to carry out the object and advantages mentioned as well as those which are inherent therein. While numerous changes may be made by those skilled in the art, such changes are encompassed within the spirit of this invention as defined by the appended claims.

What is claimed is:

1. An apparatus for preventing or limiting rotation of a downhole tool in a casing during drillout comprising an expandable sleeve disposed in the casing and not fixed thereto the sleeve being adapted to receive the tool, wherein the tool will cause the sleeve to radially expand and grippingly engage the casing to prevent or limit rotation of the tool in the casing.

2. The apparatus of claim 1 wherein the tool is a cementing plug.

3. The apparatus of claim 1 wherein the sleeve comprises overlapping first and second longitudinal edges that slide relative to one another when the sleeve radially expands.

4. The apparatus of claim 1 wherein the sleeve comprises an inner surface that tapers radially inwardly from an upper end to a lower end thereof.

5. The apparatus of claim 1 wherein the sleeve comprises an expandable material.

6. The apparatus of claim 5 wherein the expandable material is selected from the group consisting of rubbers, elastomers, plastics, wood and drillable metals.

7. The apparatus of claim 1 wherein the sleeve comprises at least one slit extending for at least a portion of a length thereof.

8. The apparatus of claim 1 wherein the sleeve comprises a plurality of slits circumferentially spaced around the sleeve.

9. The apparatus of claim 8 wherein at least a portion of the plurality of slits extend from an upper end of the sleeve downwardly for at least a portion of a length of the sleeve.

10. The apparatus of claim 8 wherein at least a portion of the plurality of slits extend from a lower end of the sleeve upwardly for at least a portion of the length of the sleeve.

11. The apparatus of claim 1 wherein the sleeve comprises a protrusion, groove or abrasive on an inner surface thereof for engaging the tool.

12. The apparatus of claim 1 wherein the sleeve comprises a protrusion, groove or abrasive on an outer surface thereof for engaging the casing.

13. The apparatus of claim 1 wherein the sleeve tapers inwardly from an upper end to a lower end thereof.

14. The apparatus of claim 1 wherein the sleeve comprises at least one stiffening rib.

15. An apparatus for preventing or limiting rotation of a cementing plug during drillout comprising:

an outer case; and an expandable sleeve slidably disposed in the outer case, wherein the sleeve is adapted to receive the cementing plug and wherein the cementing plug radially expands the expandable sleeve so that the sleeve grippingly engages the outer case when the plug is received therein.

16. The apparatus of claim 15 wherein the sleeve comprises overlapping first and second longitudinal edges that slide relative to one another when the sleeve radially expands.

17. The apparatus of claim 15 wherein the sleeve comprises an inner surface that tapers radially inwardly from an upper end to a lower end thereof.

18. The apparatus of claim 15 wherein the sleeve comprises an expandable material.

19. The apparatus of claim 18 wherein the expandable material is selected from the group consisting of rubbers, elastomers, plastics, wood and drillable metals.

20. The apparatus of claim 15 wherein the sleeve comprises at least one slit extending for at least a portion of a length thereof.

21. The apparatus of claim 15 wherein the sleeve comprises a plurality of slits circumferentially spaced around the sleeve.

22. The apparatus of claim 21 wherein at least a portion of the plurality of slits extend from an upper end of the sleeve downwardly for at least a portion of a length of the sleeve.

23. The apparatus of claim 21 wherein at least a portion of the plurality of slits extend from a lower end of the sleeve upwardly for at least a portion of the length of the sleeve.

24. The apparatus of claim 15 wherein the sleeve comprises a protrusion, groove or abrasive on an inner surface thereof for engaging the plug.

25. The apparatus of claim 15 wherein the sleeve comprises a protrusion, groove or abrasive on an outer surface thereof for engaging the casing.

26. The apparatus of claim 15 wherein the sleeve tapers inwardly from an upper end to a lower end thereof.

27. The apparatus of claim 15 wherein the sleeve comprises at least one stiffening rib.

28. An apparatus for preventing or limiting rotation of a cementing plug in a casing string comprising an expandable sleeve adapted to receive the plug therein, wherein the plug causes an outer surface of the sleeve to expand radially outwardly to engage the casing, and wherein the engagement of the sleeve with the casing will prevent, or limit rotation of the sleeve in the casing, and wherein engagement of the plug with the sleeve will prevent, or limit rotation of the plug in the sleeve.

29. The apparatus of claim 28 wherein the sleeve comprises overlapping first and second longitudinal edges that slide relative to one another when the sleeve radially expands.

30. The apparatus of claim 28 wherein the inner surface of the sleeve tapers radially inwardly from an upper end to a lower end thereof.

31. The apparatus of claim 28 wherein the sleeve comprises an expandable material.

32. The apparatus of claim 31 wherein the expandable material is selected from the group consisting of rubbers, elastomers, plastics, wood and drillable metals.

33. The apparatus of claim 28 wherein the sleeve comprises at least one slit extending for at least a portion of a length thereof.

34. The apparatus of claim 28 wherein the sleeve comprises a plurality of slits circumferentially spaced around the sleeve.

35. The apparatus of claim 34 wherein at least a portion of the plurality of slits extend from the upper end of the sleeve downwardly for at least a portion of a length of the sleeve.

36. The apparatus of claim 34 wherein at least a portion of the plurality of slits extend from a lower end of the sleeve upwardly for at least a portion of the length of the sleeve.

37. The apparatus of claim 28 comprising a protrusion, groove or abrasive on an inner surface of the sleeve for engaging the plug.

38. The apparatus of claim 28 wherein the sleeve comprises a protrusion, groove or abrasive on an outer surface thereof for engaging the casing.

39. The apparatus of claim 28 wherein the sleeve tapers inwardly from an upper end to a lower end thereof.

40. The apparatus of claim 28 wherein the sleeve comprises at least one stiffening rib.

41. A method for preventing or limiting rotation of a plug in a casing located in a wellbore comprising the steps of:

providing a casing having an expandable sleeve disposed therein;

placing the casing in a wellbore;

displacing the plug through the casing; and expanding an outer surface of the sleeve radially outwardly with the plug to grippingly engage the casing so that the plug and sleeve resist rotation during drillout.

42. The method of claim 41 wherein the sleeve comprises overlapping first and second longitudinal edges that slide relative to one another when the sleeve radially expands.

43. The method of claim 41 wherein the sleeve comprises an inner surface that tapers radially inwardly from an upper end to a lower end thereof.

44. The method of claim 41 wherein the sleeve comprises an expandable material.

45. The method of claim 44 wherein the expandable material is selected from the group consisting of rubbers, elastomers, plastics, wood and drillable metals.

46. The method of claim 41 wherein the sleeve comprises at least one slit extending for at least a portion of a length thereof.

47. The method of claim 41 wherein the sleeve comprises a plurality of slits circumferentially spaced around the sleeve.

48. The method of claim 47 wherein at least a portion of the plurality of slits extend from an upper end of the sleeve downwardly for at least a portion of a length of the sleeve.

49. The method of claim 47 wherein at least a portion of the plurality of slits extend from a lower end of the sleeve upwardly for at least a portion of the length of the sleeve.

50. The method of claim 41 wherein the sleeve comprises a protrusion, groove or abrasive on an inner surface thereof for engaging the plug.

51. The method of claim 41 wherein the sleeve comprises a protrusion, groove or abrasive on an outer surface thereof for engaging the casing.

52. The method of claim 41 wherein the sleeve tapers inwardly from an upper end to a lower end thereof.

53. The method of claim 41 wherein the sleeve comprises at least one stiffening rib.

54. The method of claim 41 further comprising the step of drilling out the sleeve and plug.

55. A method of constructing a well comprising the steps of:

drilling a wellbore in a subterranean formation;

placing a casing having an expandable sleeve slidably disposed therein in the wellbore, wherein the sleeve is adapted to receive and prevent or limit rotation of a downhole tool in the casing;

disposing the tool within the sleeve thereby expanding the sleeve with the tool so that an outer surface of the sleeve engages the casing; and drilling out the sleeve and tool.

56. The method of claim 55 wherein the tool is a cementing plug.

57. The method of claim 55 wherein the sleeve comprises overlapping first and second longitudinal edges that slide relative to one another when the sleeve radially expands.

58. The method of claim 55 wherein the sleeve comprises an inner surface that tapers radially inwardly from an upper end to a lower end thereof.

59. The method of claim 55 wherein the sleeve comprises an expandable material.

60. The method of claim 59 wherein the expandable material is selected from the group consisting of rubbers, elastomers, plastics, wood and drillable metals.

61. The method of claim 55 wherein the sleeve comprises at least one slit extending for at least a portion of a length thereof.

62. The method of claim 55 wherein the sleeve comprises a plurality of slits circumferentially spaced around the sleeve.

63. The method of claim 62 wherein at least a portion of the plurality of slits extend from an upper end of the sleeve downwardly for at least a portion of a length of the sleeve.

64. The method of claim 62 wherein at least a portion of the plurality of slits extend from a lower end of the sleeve upwardly for at least a portion of the length of the sleeve.

65. The apparatus of claim 55 wherein the sleeve comprises a protrusion, groove or abrasive on an inner surface thereof for engaging the tool.

66. The apparatus of claim 55 wherein the sleeve comprises a protrusion, groove or abrasive on an outer surface thereof for engaging the casing.

67. The method of claim 55 wherein the sleeve tapers inwardly from an upper end to the lower end thereof.

68. The method of claim 55 wherein the sleeve comprises at least one stiffening rib.

69. The method of claim 55 further comprising the step of creating openings in the casing adjacent to the formation.

70. The method of claim 55 further comprising the step of stimulating the formation to produce hydrocarbons.

71. The method of claim 55 further comprising the step of producing a fluid from the formation.

72. The method of claim 55 further comprising the step of producing hydrocarbons from the formation.

* * * * *